US008123558B2

(12) United States Patent
Su et al.

(10) Patent No.: US 8,123,558 B2
(45) Date of Patent: Feb. 28, 2012

(54) MINIATURIZED ELECTRICAL CONNECTOR HAVING HIGH SIGNAL TRANSMISSION RATE

(75) Inventors: Yu-Hung Su, Tu-Cheng (TW); Yao-Ting Wang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 38 days.

(21) Appl. No.: 12/843,857

(22) Filed: Jul. 26, 2010

(65) Prior Publication Data

US 2012/0021647 A1 Jan. 26, 2012

(51) Int. Cl.
*H01R 13/648* (2006.01)

(52) U.S. Cl. ..... 439/607.01; 439/660

(58) Field of Classification Search ..... 439/607.01, 439/607.41, 660, 607.54
See application file for complete search history.

(56) References Cited

U.S. PATENT DOCUMENTS 7,534,143 B1 * 5/2009 Tsao et al. ..... 439/607.41
7,618,293 B2 * 11/2009 Wu ..... 439/660
7,717,733 B1 * 5/2010 Yi et al. ..... 439/452
7,896,559 B2 * 3/2011 Yi et al. ..... 385/75
7,909,653 B1 * 3/2011 Wan et al. ..... 439/660
7,942,704 B2 * 5/2011 Ko et al. ..... 439/660
2009/0130906 A1 * 5/2009 Tsao et al. ..... 439/626
2010/0290745 A1 * 11/2010 Liao et al. ..... 385/90

* cited by examiner

*Primary Examiner* — Hae Moon Hyeon

(74) *Attorney, Agent, or Firm* — Cheng-Ju Chiang

(57) ABSTRACT

An electrical connector includes a first insulating body having a base board and a first tongue board extending rearward from a bottom of the base board, first terminals each having a first contact portion disposed on the base board, a second insulating body having a base portion and a second tongue board extending forward from a bottom of the base portion, and second terminals each having a second contact portion stretching out of a front of the base portion and disposed above the second tongue board. Two opposite sides of the first tongue board protrude upward to form two clipping walls defining a receiving space therebetween. The second insulating body is received in the receiving space of the first insulating body with the base portion being clipped between the clipping walls and a front end of the second tongue board abutting against a rear end of the base board.

10 Claims, 3 Drawing Sheets

MINIATURIZED ELECTRICAL CONNECTOR HAVING HIGH SIGNAL TRANSMISSION RATE

BACKGROUND OF THE INVENTION

1. Field of the Invention

The present invention relates to an electrical connector, and more particularly to an electrical connector having high signal transmission rate.

2. The Related Art

With the development of electronic technology, electronic products need to be increasingly miniaturized and have high signal transmission rate. Conventionally, in order to have a high signal transmission rate, two or more traditional electrical connectors are pieced together. However, the pieced electrical connector often occupies a relatively large space so that cannot meet the requirement of miniaturization. Furthermore, the process of piecing together the traditional electrical connectors often need to take a great deal of manpower and material resources so that results in too high manufacture cost and lower productivity.

SUMMARY OF THE INVENTION

It is an object of the present invention to provide an electrical connector. The electrical connector includes a first insulating body having a base board and a first tongue board extending rearward from a bottom of the base board, a plurality of first terminals disposed in the first insulating body respectively and spaced from one another along a transverse direction of the first insulating body, a second insulating body assembled to the first insulating body, and a plurality of second terminals disposed in the second insulating body respectively and spaced from one another along a transverse direction of the second insulating body. Two opposite sides of the first tongue board protrude upward to form a pair of clipping walls defining a receiving space therebetween for receiving the second insulating body therein. Each of the first terminals has a first contact portion disposed in the base board and projecting beyond a top surface of the base board. The second insulating body has a base portion clipped between the clipping walls, and a second tongue board extending forward from a bottom of the base portion. A front end of the second tongue board abuts against a rear end of the base board. Each of the second terminals has a second contact portion stretching out of a front of the base portion to be disposed in the second tongue board and projecting beyond a top of the second tongue board.

As described above, in the process of assembling the electrical connector of the present invention, the second insulating body can be easily assembled to the first insulating body so that economizes a great deal of manpower and material resources, reduces manufacture cost of the electrical connector, and further increases productivity of the electrical connector. Moreover, the electrical connector of the present invention can meet the requirements of miniaturization and high signal transmission rate.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 2:
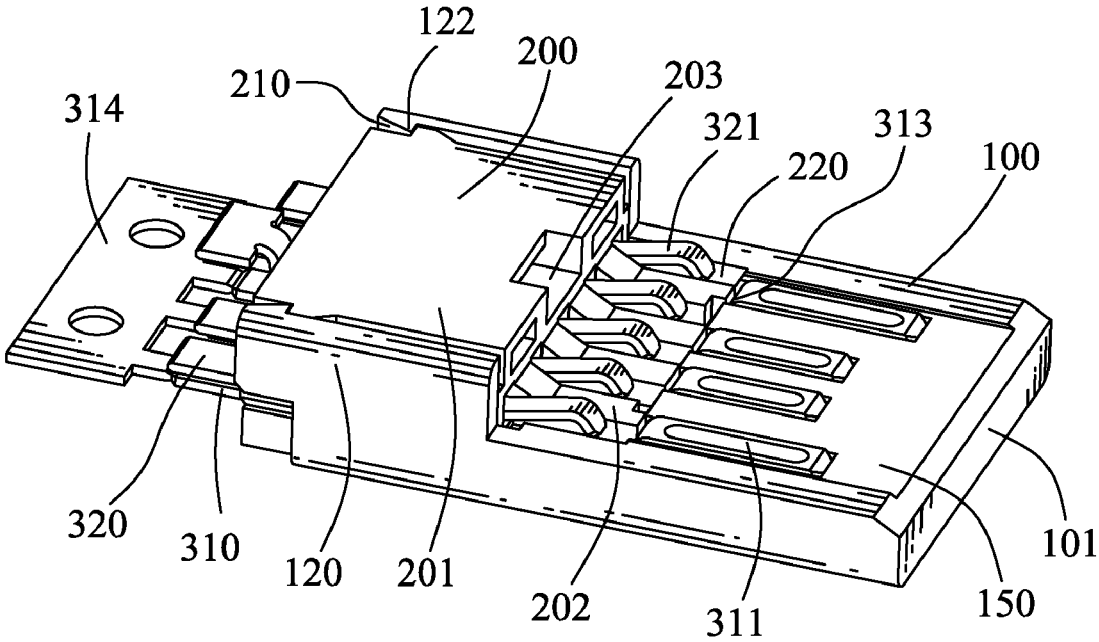
FIG. 2 is a perspective view of the electrical connector of FIG. 1 except a shielding shell.

Referring to FIG. 2, an electrical connector according to the present invention includes a first insulating body 100, a second insulating body 200 mounted to the first insulating body 100, a plurality of first terminals 310 disposed in the first insulating body 100, and a plurality of second terminals 320 disposed in the second insulating body 200.

Figure 3:
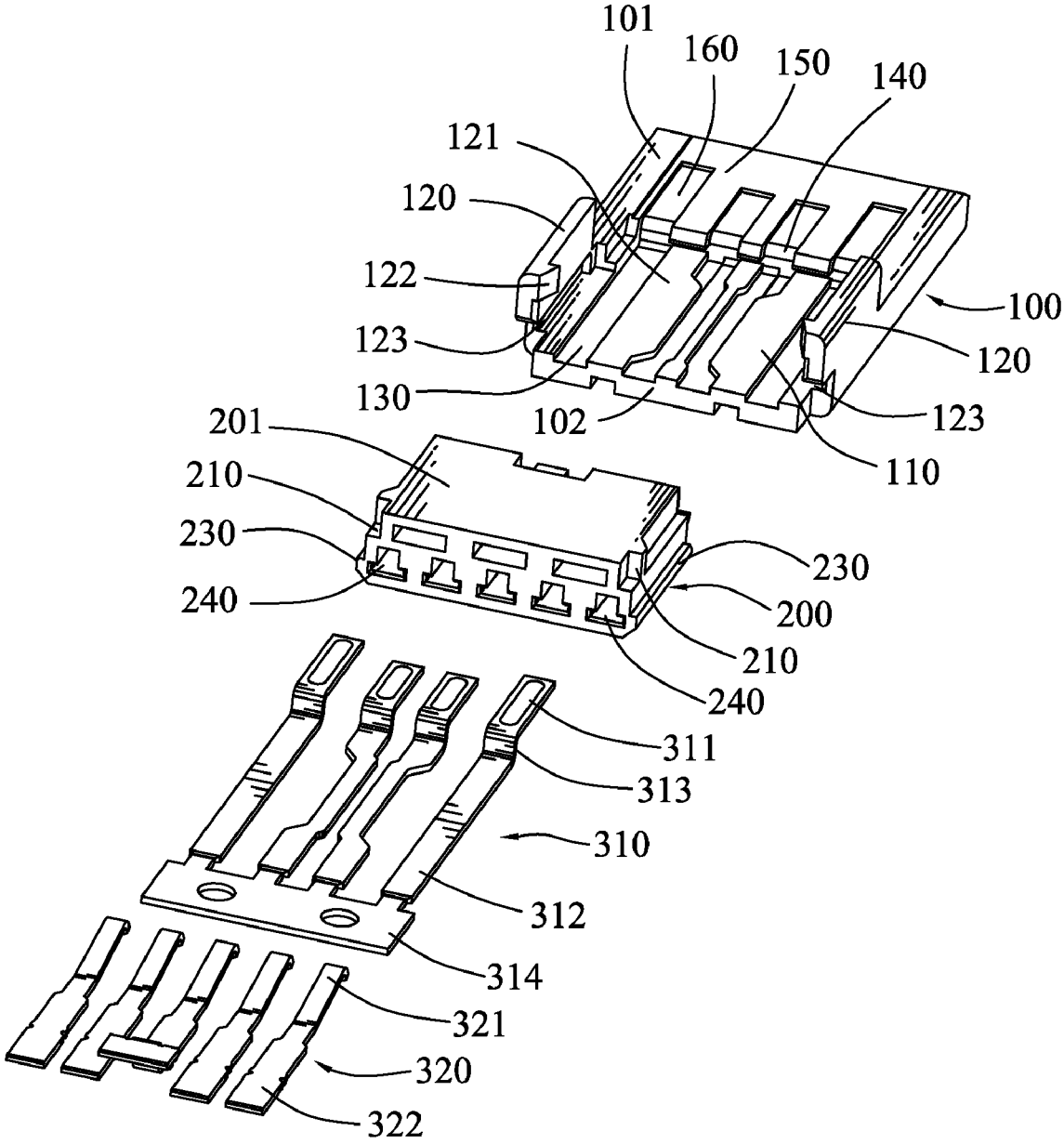
FIG. 3 is an exploded perspective view of the electrical connector without the shielding shell of FIG. 2.
Figure 4:
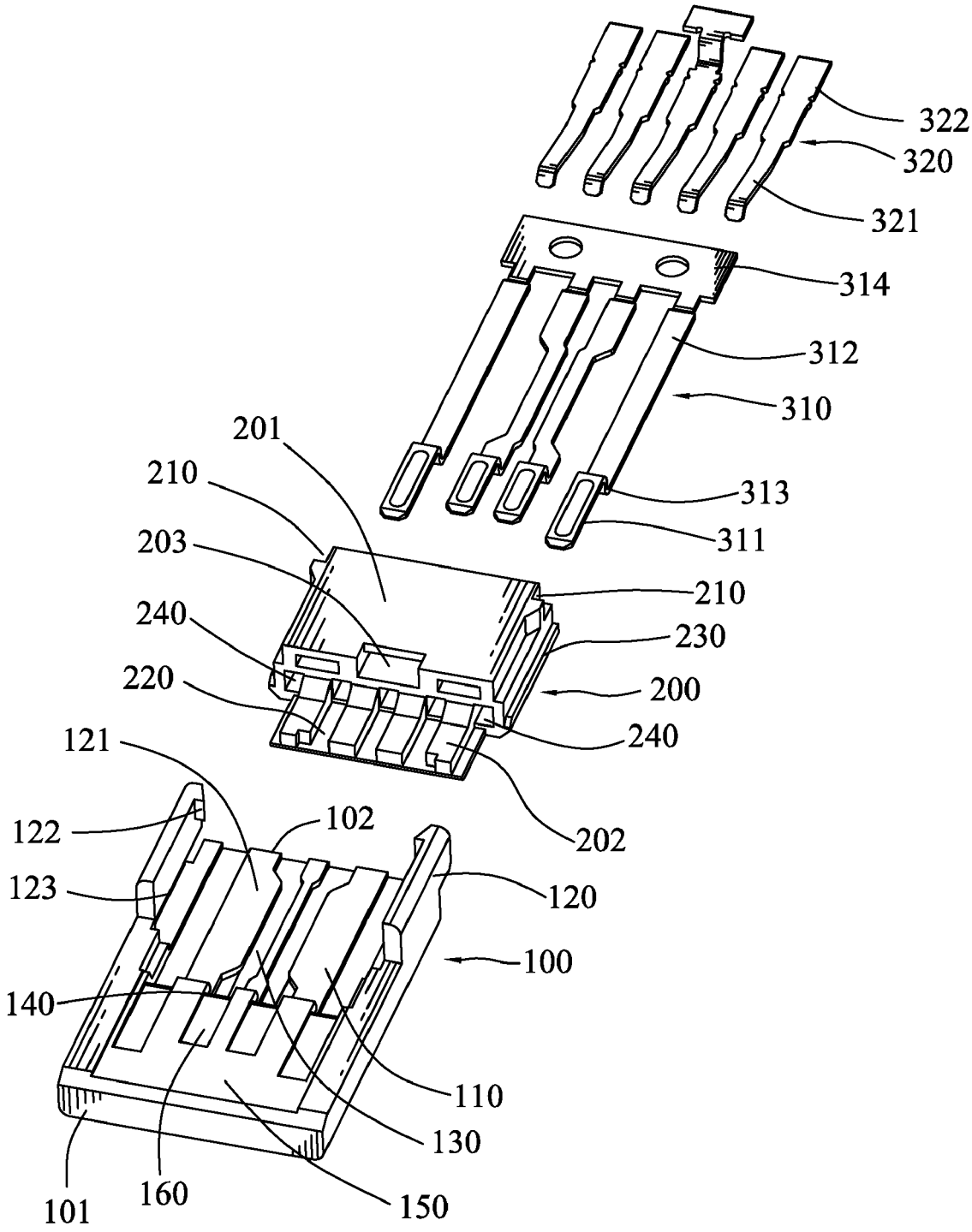
FIG. 4 is another angle of exploded perspective view of the electrical connector without the shielding shell of FIG. 2.

Referring to FIG. 3 and FIG. 4, the first insulating body 100 has a rectangular base board 101 disposed levelly, and a rectangular first tongue board 102 which is formed by the base board 101 stretching rearward from a bottom of a rear thereof. Two opposite side edges of the first tongue board 102 protrude upward beyond a top surface 150 of the base board 101 to form a pair of clipping walls 120 which define a receiving space 121 therebetween. Tops of rear ends of the pair of clipping walls 120 protrude towards each other to form a pair of buckling barbs 122. A restraining channel 123 is opened in a lower portion of an inside of the clipping wall 120 to communicate with the receiving space 121, and extends longitudinally with a rear end thereof being opened freely. A top face 110 of the first tongue board 102 defines a plurality of fastening cavities 130 communicating with the receiving space 121 and arranged at regular intervals along a transverse direction thereof. Each of the fastening cavities 130 extends longitudinally to penetrate through the first tongue board 102. The top surface 150 of the base board 101 defines a plurality of receiving cavities 160 one-on-one corresponding to the fastening cavities 130, and each extending longitudinally to be connected with a front end of one of the fastening cavities 130 by means of a connecting passage 140 opened at a rear end of the base board 101.

Each of the first terminals 310 has a fastening strip 312 and a first contact portion 311 which is connected with one end of the fastening strip 312 in a step manner by a connecting portion 313. The first terminals 310 are formed by extending forward from a front edge of a shaping part 314 and spaced from one another along a transverse direction of the shaping part 314, wherein the other ends of the fastening strips 312 are connected with the front edge of the shaping part 314. The fastening strips 312 are secured in the fastening cavities 130 of the first insulating body 100 respectively, the first contact portions 311 are disposed in the corresponding receiving cavities 160 and project beyond the top surface 150 of the base board 101, and the connecting portions 313 are restrained in the corresponding connecting passages 140. The shaping part 314 is exposed behind the first tongue board 102 of the first insulating body 100. In this embodiment, in order to achieve a firmer engagement between the first terminals 310 and the first insulating body 100, the fastening strip 312 may be designed with a crooked shape, and accordingly, the corresponding fastening cavity 130 is altered to match with the fastening strip 312 of the crooked shape.

Referring to FIG. 3 and FIG. 4 again, the second insulating body 200 has a rectangular base portion 201 and a second tongue board 202 which is formed by the base portion 201 stretching forward from a bottom of a front thereof. A buckling fillister 203 is opened in a top of the base portion 201. Tops of rear ends of two opposite sides of the base portion 201 are provided with a pair of buckling gaps 210. A pair of restraining ribs 230 oppositely protrudes outward from lower portions of the two opposite sides of the base portion 201 and each extends longitudinally to match with the restraining channel 123 of the first insulating body 100. The base portion 201 defines a plurality of fastening passageways 240 arranged at regular intervals along a transverse direction thereof and each extending longitudinally to penetrating through the base portion 201. A top of the second tongue board 202 defines a plurality of receiving fillisters 220 each extending longitudinally to be aligned with one of the fastening passageways 240 and further connected with a front end of the corresponding fastening passageway 240.

Each of the second terminals 320 has a fastening slice 322 and a second contact portion 321 which is connected with one end of the fastening slice 322 and slanted beyond a plane of the fastening slice 322. The fastening slices 322 are secured in the fastening passageways 240 of the second insulating body 200 respectively. The second contact portions 321 stretch out of the front of the base portion 201 and are located above the corresponding receiving fillisters 220. When the second contact portions 321 electrically connect with a mating connector, the second contact portions 321 are pressed into the receiving fillisters 220 respectively.

Referring to FIG. 2, when the second insulating body 200 with the second terminals 320 is assembled to the first insulating body 100 with the first terminals 310, the second insulating body 200 is firstly inserted forward to make the second tongue board 202 received in the receiving space 121, and the restraining ribs 230 inserted into the corresponding restraining channels 123. Then the second insulating body 200 keeps on being pushed forward to make the restraining ribs 230 slide forward along the corresponding restraining channels 123 until a front end of the second tongue board 202 abuts against the rear end of the base board 101. At this time, the base portion 201 is received in the receiving space 121 and clipped between the clipping walls 120. The buckling barbs 122 are buckled in the buckling gaps 210 respectively to prevent the second insulating body 200 from moving rearward, and the restraining ribs 230 are restrained in the corresponding restraining channels 123, so that make the second insulating body 200 firmly engaged with the first insulating body 100. A bottom surface of the base portion 201 of the second insulating body 200 abuts against the top face 110 of the first tongue board 102 of the first insulating body 100 so as to further restrain the fastening strips 312 of the first terminals 310 in the fastening cavities 130. Moreover, the front end of the second tongue board 202 abuts against the rear end of the base board 101 and restrains the connecting portions 313 in the respective connecting passages 140, so that further ensures the first terminals 310 firmly assembled in the first insulating body 100. Lastly, the shaping part 314 is cut off from the fastening strips 312.

Figure 1:
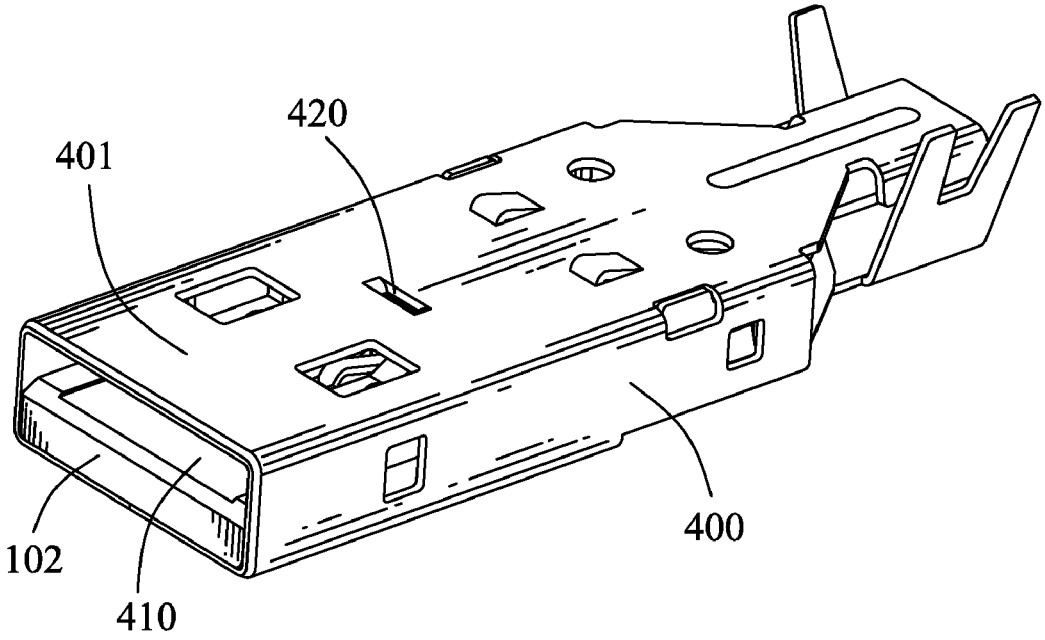
FIG. 1 is a perspective view of an electrical connector in accordance with the present invention.

Referring to FIG. 1, the electrical connector further includes a rectangular hollow shielding shell 400 enclosing the first insulating body 100 and the second insulating body 200, with an inserting space 410 being formed between a top plate 401 of the shielding shell 400 and the tongue boards 102, 202. A locking barb 420 is provided at an inside of the top plate 401 and buckled in the buckling fillister 203 of the second insulating body 200 to make the shielding shell 400 firmly secured around the insulating bodies 100, 200. The shielding shell 400 not only can protect the insulating bodies 100, 200 and the terminals 310, 320 from harm, but also can shield the terminals 310, 320 from static electricity.

As described above, in the process of assembling the electrical connector of the present invention, the second insulating body 200 can be easily assembled to the first insulating body 100 so that economizes a great deal of manpower and material resources, reduces manufacture cost of the electrical connector, and further increases productivity of the electrical connector. Moreover, the electrical connector of the present invention can meet the requirements of miniaturization and high signal transmission rate.

What is claimed is:

1. An electrical connector, comprising:

a first insulating body having a base board and a first tongue board extending rearward from a bottom of the base board, two opposite sides of the first tongue board protruding upward to form a pair of clipping walls defining a receiving space therebetween;

a plurality of first terminals disposed in the first insulating body respectively and spaced from one another along a transverse direction of the first insulating body, each of the first terminals having a first contact portion disposed in the base board and projecting beyond a top surface of the base board;

a second insulating body received in the receiving space of the first insulating body, the second insulating body having a base portion clipped between the clipping walls, and a second tongue board extending forward from a bottom of the base portion, a front end of the second tongue board abutting against a rear end of the base board; and a plurality of second terminals disposed in the second insulating body respectively and spaced from one another along a transverse direction of the second insulating body, each of the second terminals having a second contact portion stretching out of a front of the base portion to be disposed in the second tongue board and projecting beyond a top of the second tongue board.

2. The electrical connector as claimed in claim 1, wherein tops of rear ends of the pair of clipping walls protrude towards each other to form a pair of buckling barbs, tops of rear ends of two opposite sides of the base portion are provided with a pair of buckling gaps, the buckling barbs are buckled in the buckling gaps respectively to prevent the second insulating body from moving rearward.

3. The electrical connector as claimed in claim 2, wherein a restraining channel is opened in a lower portion of an inside of the clipping wall to communicate with the receiving space, and extends longitudinally with a rear end thereof being opened freely, a pair of restraining ribs oppositely protrudes outward from lower portions of the two opposite sides of the base portion and each extends longitudinally to slide along the corresponding restraining channel and then be restrained in the corresponding restraining channel.

4. The electrical connector as claimed in claim 1, wherein the first terminal further has a fastening strip connected with the first contact portion in a step manner by a connecting portion, the fastening strip is secured in the first tongue board of the first insulating body, and the connecting portion is disposed in the rear end of the base board.

5. The electrical connector as claimed in claim 4, wherein a top face of the first tongue board defines a plurality of fastening cavities communicating with the receiving space, the top surface of the base board defines a plurality of receiving cavities each connected with a front end of one of the fastening cavities by means of a connecting passage opened at the rear end of the base board, the fastening strip is secured in the fastening cavity, the first contact portion is disposed in the receiving cavity, and the connecting portion is restrained in the connecting passage, a bottom surface of the base portion of the second insulating body abuts against the top face of the first tongue board to further restrain the fastening strips of the first terminals in the fastening cavities, the front end of the second tongue board abuts against the rear end of the base board to further restrain the connecting portions in the respective connecting passages.

6. The electrical connector as claimed in claim 4, wherein the fastening strip is designed with a crooked shape.

7. The electrical connector as claimed in claim 1, wherein the second terminal further has a fastening slice connected with the second contact portion, the second contact portion is slanted beyond a plane of the fastening slice, the fastening slice is secured in the base portion.

8. The electrical connector as claimed in claim 7, wherein the base portion defines a plurality of fastening passageways each extending longitudinally to penetrating through the base portion, the top of the second tongue board defines a plurality of receiving fillisters each aligned with one of the fastening passageways and connected with a front end of the corresponding fastening passageway, the fastening slices are secured in the fastening passageways respectively, the second contact portions are received in the corresponding receiving fillisters and project upward out of the corresponding receiving fillisters.

9. The electrical connector as claimed in claim 1, further comprising a shielding shell enclosing the first insulating body and the second insulating body, with an inserting space being formed between a top plate of the shielding shell and the tongue boards.

10. The electrical connector as claimed in claim 9, wherein a buckling fillister is opened in a top of the base portion of the second insulating body, a locking barb is provided at an inside of the top plate of the shielding shell to be buckled in the buckling fillister.

* * * * *